United States Patent [19]

Hanlet

[11] 4,376,256

[45] Mar. 8, 1983

[54] SEGMENT DISPLAY SYSTEM

[75] Inventor: Jacques M. Hanlet, Loxahatchee, Fla.

[73] Assignee: Alpha-Omega Development, Inc., Loxahatchee, Fla.

[21] Appl. No.: 229,515

[22] Filed: Jan. 29, 1981

Related U.S. Application Data

[63] Continuation-in-part of Ser. No. 121,918, Mar. 5, 1980, Pat. No. 4,341,976.

[51] Int. Cl.[3] ..... H01J 1/20; H01J 61/09; H01J 61/42

[52] U.S. Cl. ..... 313/210; 313/485; 313/491; 315/169.4

[58] Field of Search ..... 313/182–189, 313/209–218, 484–486, 491, 482, 230, 6; 315/169.4, 58, 167

[56] References Cited

U.S. PATENT DOCUMENTS

| | | | |
|---|---|---|---|
| 1,830,163 | 11/1931 | Gray | 313/183 X |
| 1,991,479 | 2/1935 | Williams | 313/216 X |
| 2,595,617 | 5/1952 | Toulon | 313/189 X |
| 2,971,109 | 2/1961 | Jackson et al. | 313/188 |
| 3,042,823 | 7/1962 | Willard | 313/6 |
| 3,089,054 | 5/1963 | Walsh et al. | 313/209 X |
| 3,249,802 | 5/1966 | Nakajo et al. | 315/167 |
| 3,334,269 | 8/1967 | L'Heureux | 315/58 |
| 3,476,970 | 11/1969 | Gillies et al. | 313/216 X |
| 3,559,190 | 1/1971 | Bitzer et al. | 313/484 X |
| 3,662,214 | 5/1972 | Lustig | 313/209 X |
| 3,743,879 | 7/1973 | Kupsky | 313/484 |
| 3,899,707 | 8/1975 | Sasaki et al. | 313/220 |
| 3,952,221 | 4/1976 | Kamegaya et al. | 313/209 X |
| 3,983,445 | 9/1976 | Yasuda et al. | 313/485 |
| 3,986,074 | 10/1976 | Watanabe et al. | 313/485 |

*Primary Examiner*—Marvin L. Nussbaum
*Attorney, Agent, or Firm*—Morton J. Rosenberg

[57] ABSTRACT

A segment display system (10) whereby ultraviolet energy is generated and contacted with fluorescent material coatings (78) to create electromagnetic wave generation within the visible bandwidth of the electromagnetic spectrum through fluorescent excitation of the fluorescent material coatings (78). Ultraviolet energy is generated from the ionization of metallic atoms from a metallic coating (42) coated to through opening sidewalls (40) of slots (38) forming the cathode mechanism (26). The slot through openings (38) are in registration with the fluorescent material coatings (78) mounted on a display panel member (80). Below the cathode mechanism (26) is a common anode element (62). Each of the metallic coatings (42) formed within each of the slot through openings (38) is coupled to an external electrical source as is the anode element (62). The segment display system (10) is formed into a monolithic structure which includes the internal chamber (64) within which an inert or combination of inert gases is introduced. Electrical energization of the cathode elements and the anode element (62) results in ionization of metal atoms emitted from the metallic coating (42). The ionization process provides for ultraviolet radiation which is directed to the fluorescent material coating (78). The coatings (78) are generally linearly extended and are formed into a predetermined pattern in order to provide information output responsive to a predetermined cathode element being energized in combination with the energization of the common anode element (62).

35 Claims, 5 Drawing Figures

FIG. 1
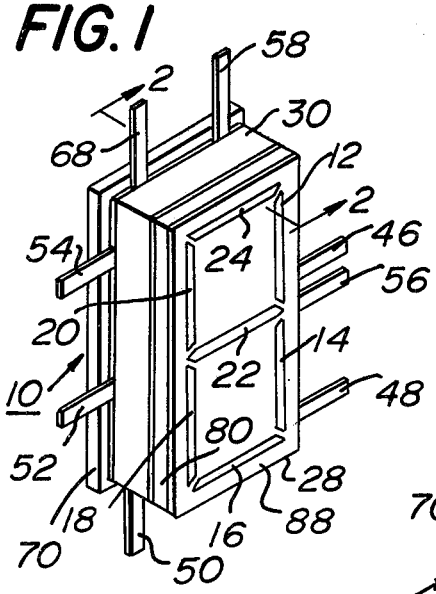
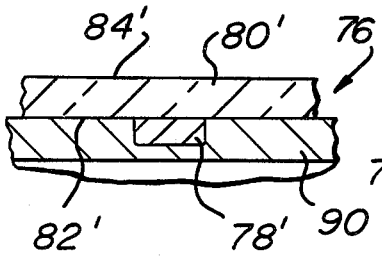
FIG. 5
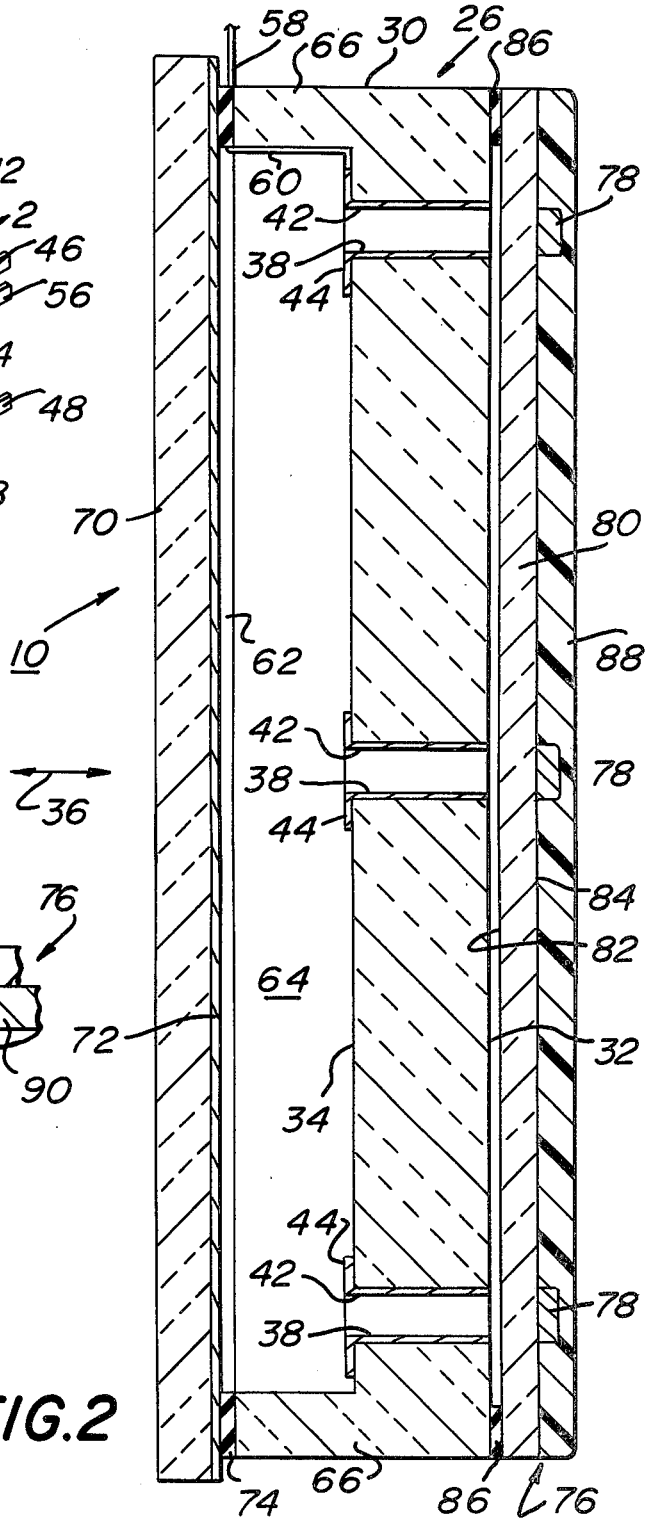
FIG. 2

SEGMENT DISPLAY SYSTEM

RELATED REFERENCES

This invention is a continuation-in-part of U.S. Patent Application Ser. No. 121,918, filed Mar. 5, 1980, and now U.S. Pat. No. 4,341,976, entitled "DISPLAY SYSTEM".

BACKGROUND OF THE INVENTION

1. Field of the Invention

This invention relates to segment display systems. In particular, this invention pertains to segment display systems which provide predetermined pattern displays resulting from the conversion of long wave ultraviolet photons into visible light energy through excitation of flourescent material coatings such as synthetic Phosphors. More in particular, this invention relates to segment display systems wherein ultraviolet radiation is produced by the ionization of metal atoms through an electric field applied internal to generally linearly directed slot through openings to form hollow cathodes having a metallic sidewall coating. Further, this invention pertains to segment display systems where long wave ultraviolet photons are directed in a controlled manner from a cathode mechanism to an impingement on fluorescent material compositions. More in particular, this invention relates to segment display systems wherein visual segment areas are formed in a predetermined pattern such as a seven or fourteen segment display, wherein such display visualizes numeric and alphabet type characters.

2. Prior Art

Segment display systems are known in the art. Various segment display systems rely on light emitting diode, or liquid crystal diode actuation. Other types of display systems rely on gas discharge and are known in the art.

It is believed that the various gas discharge display systems of the prior art are the closest art to the subject segment display system. The subject display system is not classified as a gas discharge display, however, such prior art gas discharge systems generally rely on a multiplicity of plasma displays which may be attained either as alphanumeric displays having generally linearly or arcuately segmented cathodes or dot matrices. Such prior art systems are generally based on the ionizatior of a noble gas or gas mixtures. In such prior art systems, the ionization occurs generally between flat and parallel electrodes with generally the anode electrode being transparent to light generated in the neighborhood of the cathode electrode.

Various disadvantages are found when such prior art gas discharge display systems are used. In such prior art gas discharge systems, the visible glow from the cathode surface is visibly stable only if the totality of the surface area of the cathode is uniformly covered by the glow and the cathode surface has uniform properties. In the event that either of these conditions is not found, the visible light will provide a flickering effect which is deleterious to an observer.

Another disadvantage of such prior art gas discharge systems is that the operating life of such is dependent upon the sputtering rate from the cathode electrode. This is generally due to the fact that the sputtering of the material from the cathode electrode deposits itself on the anode electrode. This reduces the anode electrode's transparency.

In such prior art systems, the sputtering also reduces the gas pressure by physical adsorption of the filling gas. In order to provide an acceptable operating light of such prior art systems, they are generally operated at lower than the maximum current density, which results in less than optimum light output.

Other prior art gas discharge displays using hollow cathodes are known in the art, and are represented in U.S. Pat. Nos. 3,882,342 and 4,021,695. As in the case of other prior art, such references use the back filling gas to produce ultraviolet radiation in the positive column. This type of approach suffers from the same disadvantages as has been previously described. In opposition, the subject display system does not require the gaseous medium to produce a measurable amount of ultraviolet energy. The gaseous medium in the subject display system is used to sputter the atoms of metal from the cathode and the applied electrical field ionizes such atoms to produce an intense utltraviolet glow. Such an ultraviolet glow produced from the ionization of the metal atoms is greater than the intensity of the ultraviolet glow from the gaseous medium.

SUMMARY OF THE INVENTION

A segment display system which includes a cathode mechanism adapted to produce energy in the ultraviolet bandwidth of the electromagnetic spectrum responsive to the ionization of metal atoms. The cathode mechanism defines a cathode plate member having a plurality of discrete slots formed therethrough. The cathode plate member has opposing first and second surfaces, with each of the slots defining a sidewall having a metallic coating formed thereon. The segment display system further includes a common anode mechanism fixedly secured to the cathode plate member and displaced from the cathode plate member second surface for forming an internal chamber therebetween. Finally, the segment display system further includes a display panel mechanism secured to the cathode plate member first surface. The display panel mechanism has formed thereon a plurality of fluorescent material coatings in registration with the cathode plate member through slots.

BRIEF DESCRIPTION OF THE DRAWINGS

FIG. 1 is a perspective view of the segment display system;

FIG. 2 is a cross-sectional view of the segment display system taken along the Section Lines 2—2 of FIG. 1;

DESCRIPTION OF THE PREFERRED EMBODIMENTS

Figure 3:
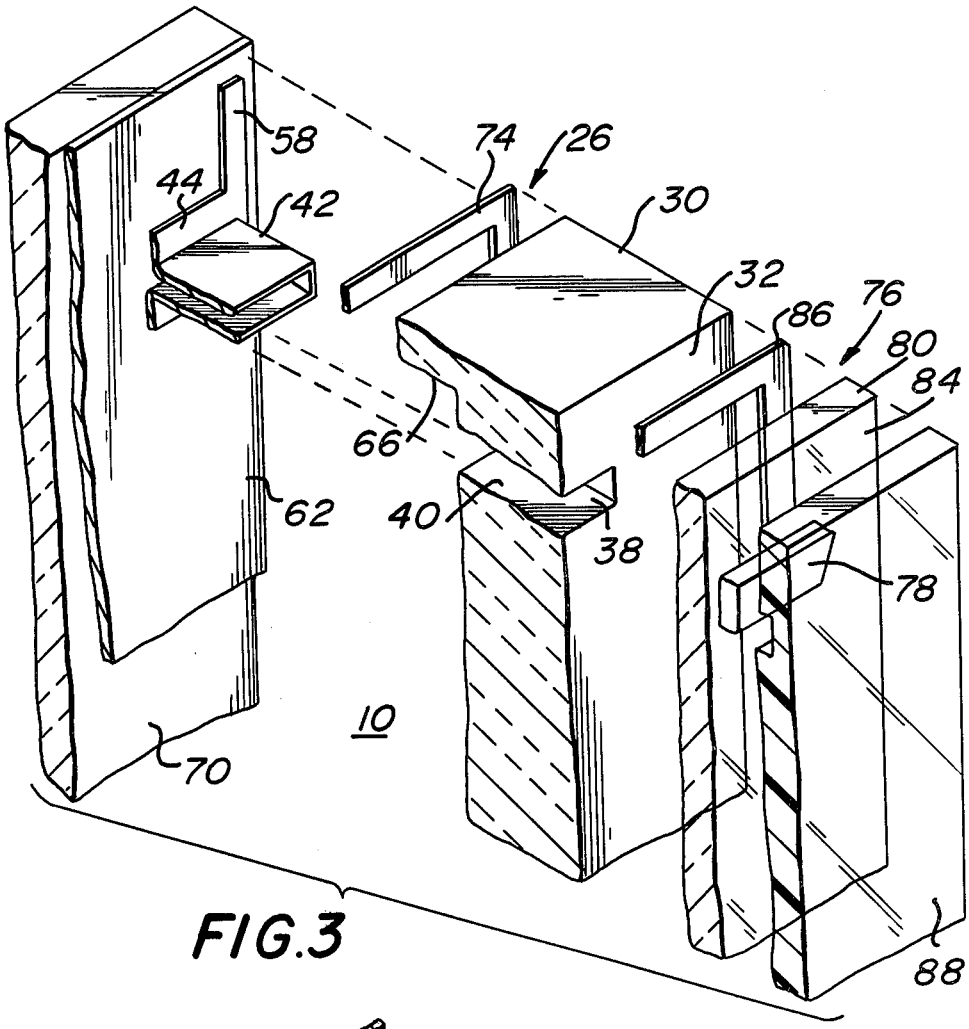
FIG. 3 is an exploded perspective view of a cut-away section of the segment display system.

Referring now to FIGS. 1–4, there is shown the basic structure of segment display 10. The overall purpose and objective of segment display 10 is to produce a visual output of integers from 0–9 responsive to predetermined electrical actuation, as will be described in following paragraphs. As seen in FIG. 1, segment display system 10 is formed of seven visual segments 12, 14, 16, 18, 20, 22, and 24. The concept of using seven visual segments for the presentation of the concept of this invention does not preclude the use of other numbers of visual segments such as fourteen, which may also be utilized for presenting integer and alphanumeric representations. Additionally, other numbers of visual segments may be used to provide alphabet representations or other types of visual designs. Still further, the basic concept as hereinafter will be described, directs itself to not only linear visual segments, but also to arcuately contoured segments for other types of design considerations. The reason that a seven segment visual display system 10 is represented is only due to the fact that such is currently used in the commercial marketplace, and provides a generally acceptable type commercial representation of the overall concept.

In overall concept, segment display system 10 will be seen to convert energy within the ultraviolet bandwidth of the electromagnetic spectrum into energy within the visible bandwidth of the electromagnetic spectrum through excitation of fluorescent materials. The concept as herein described is similar in nature to that provided in U.S. Patent Application Ser. No. 121,918, filed Mar. 5, 1980, now U.S. Pat. No. 4,341,976, and entitled "DISPLAY SYSTEM".

Previous systems provide for plasma displays, however, they generally rely on the ionization of some type of inert or noble gas, or a mixture of gases between a pair of electrodes. In these cases, the anode is generally transparent to light energy generated in the neighborhood of the cathode when a voltage is applied between the anode and the cathode.

In contradistinction, the subject segment display system 10 directs itself to the production of energy within the ultraviolet bandwidth of the electromagnetic spectrum responsive to ionization of metal atoms. This ultraviolet energy is not in the visible spectrum of the electromagnetic bandwidth, however, such is directed to a fluorescent material and activates such to provide a visual output through the visual segments 12–24.

The ultraviolet radiation which is directed to the fluorescent material is generated by a gaseous plasma originating in the negative glow captured or within a slot shaped cathode. In the case of segment display system 10, as herein described, the slot shaped cathode will be seen to be generally linearly directed. The energy produced comes from ionized atoms of metal which are sputtered from the cathode surface and consists of the ionized metals largest spectral lines. These spectral lines are generally found in the ultraviolet bandwidth of the electromagnetic radiation spectrum.

In more detail, but still on the conceptual level, it will be seen in following paragraphs that a noble gas is ionized by application of a voltage potential between an anode and a cathode. Application of the potential ionizes the gas which produces electrons and gaseous ions. As is the general case, the electrons are displaced toward the anode and the ions are displaced toward the cathode to impinge thereon. The cathode is formed of a metallic coating layer which, when impinged by the ion, displaces an electron, and subsequently an atom of the metal which is ionized.

The atom of metal is generally in the gaseous state and emits ultraviolet energy along its strongest spectral line. This ultraviolet energy impinges on the fluorescent material and causes excitation thereof to provide a visual output along the visual segments 12–24.

The negative glow on the cathode provides the origination of the gaseous plasma which is confined within the linearly directed slot envelope of the cathode structure. The gaseous plasma includes the atoms of metal which are ionized and the particulates of metal sputtered from the surface provides for the ultraviolet spectral radiation lines. Metal coated cathodes provide intense radiation at various radiation frequencies. This is dependent upon the type of metal cathode coating being used. Thus, when impinged by ionized or metastable atoms of a noble or inert gas, such as Helium, Argon, Neon, Krypton, Xenon, or some like gas or combination thereof, various metal coated cathodes provide intense radiation at predetermined radiation frequencies. Some metal cathode coatings being commercially acceptable and used are presented in the following Table:

| METAL CATHODE COATING | APPROXIMATE RADIATION FREQUENCY |
|---|---|
| Nickel | 2300 A° |
| Mercury | 2500 A° |
| Copper | 3200 A° |
| Aluminum | 3900 A° |
| Lead | 2200 A° |

It is seen that the Nickel coated cathode provides an intense radiation at approximately 2300 $a^0$. Mercury emits at a level approximating 2500 $a^0$, however, such has approximately twice the intensity of the Nickel spectrum lines. Copper coating on the other end has an intensity approximating four times that of the Nickel coating, but at a spectral line approximating 3200 $a^0$. Other metals such as Aluminum, Lead, have different intensity line frequency levels with differing intensities generally directed to the particular metal. The use of a particular coating would be dependent upon the particular use and output needed from a segment display system 10.

Referring now to the basic theory of operation of segment display system 10, it is to be noted that such is directed to a hollow type cavity cathode, which includes a particular or predetermined metallic coating layer formed on the sidewalls. The metallic coating may be that as shown in previously referenced Table, or may be another type of metallic coating not important to the inventive concept as is herein described, with the exception that such produces metallic sputtering in a predetermined range necessary for a predetermined use of segment display system 10. The cathode member includes an annular extension of the metallic coating which will be seen to lie in a plane substantially parallel to a common anode element displaced from the cathode member.

Upon application of a potential between the common anode and a particular cathode section associated with one or more of the visual segments 12–24, there is applied a predetermined breakdown voltage described in Paschen's Law. As is well-known, this Law states that the breakdown potential between the terminals in a gas is proportional to the pressure multiplied by the gap length. Thus, the gap length is clearly seen to be inversely proportional to the pressure of the gas. Current that flows is limited by the resistance provided in the circuit and if the current is limited to a low value, the glow that occurs is provided on the annular extension of the cathode mechanism. This would be the first phase of the initiation of a visual output from the visual segments 12–24.

In this initial phase, the gas is ionized and generates ions, electrons, and metastables. The metastables, as well as photons, are neutral components and the field has substantially no effect on them and their paths direction is generally considered to be a random type displacement. It is noted that in flat parallel electrode type plasma display systems, only a small portion of the metastables and photons are able to intercept the cathode and contribute to any secondary emissions of electrons.

In the current segment display system 10, in complete contradistinction to the flat parallel type electrode systems, the ion is attracted to the cathode and the electron which is produced is attracted to the anode. The ions intercept the surface of the cathode metallic coating and if the ions have sufficient energy, an electron is extracted from the cathode surface which initially must neutralize the ion. Note that in the event that more than one electron is released during this phase of the operation, the extra electron is accelerated by the field in a displacement path toward the anode.

When the electron is displaced, such collides with gaseous atoms and additional ions are produced which progressively increase the current. The positive ions satisfying this process have an energy at least twice the work function of the metal coating of the cathode. Photons of energy equal to or greater than the work function of the metal coating also extract electrons from the metal by what is commonly referred to as the photoelectric effect.

Work functions for most metals generally vary, however, the work function for most clean surfaces of metals is between the approximate range of 4.0–5.0 electron volts. This energy corresponds to ultraviolet radiation in the approximate bandwidth of 2500 $a^0$–3100 $a^0$. However, noble gases have low intensity of ultraviolet radiation compared to their radiation intensity in the visible portion of the electromagnetic spectrum. Such photons contribute minutely in producing secondary electrons from the radiative emission of the gases.

Thus, an initial phase of the operation is completed and subsequent to this, the series resistance placed between one of the electrodes, either the common anode or the particular cathode associated with one or more of the visual segments 12–24, may be decreased. This is a secondary phase of the operation and can easily be attained through well-known scanning mechanisms, or modulation which are well-known in the art. Basically, when the resistance is decreased, the current that flows is greater than the current attained in the initial phase of the operation between the annular cathode section and the common anode. The glow now is seen to penetrate internal to the cavity of the cathode mechanism and the efficiency of producing secondary electrons is increased due to the fact that the fraction of metastable atoms and photons reaching the cathodic surface is in the neighborhood of unity. Note that the fraction of metastable atoms and photons reaching the cathodic surface for flat parallel electrodes has been found to be less than 0.5.

Additionally, in this phase of the operation, each electron effects more collisions which both ionizes and excites the environment contained therein prior to reaching the anode. In this manner, the efficiency of the gas discharge is further increased and more electrons are produced. Thus, there is eventually provided additional current, as well as increased light energy.

When the segment display system 10 is initially fired, there is a low current flowing between the annular section of the cathode and the common anode element. Thus, there is a small potential drop across the load resistance which is subtracted from the total voltage that is supplied from the source of energy. This represents the voltage that appears between the anode and cathode elements and corresponds to the striking voltage which is dependent on the pressure and the anode/-cathode gap distance.

In the secondary phase of the operation or actuation, a greater current flows through the system and the voltage drop across the series resistance increases, since there is a current that may be many orders of magnitude greater than previously achieved in the first phase of operation.

Obviously, the drop of potential corresponds to the increase of the current. The voltage that now appears between the anode element and the cathode would be smaller than the normal sustaining voltage that would be used between a parallel anode and cathode electrode system of the prior art.

The glow between the annulus and the anode in this secondary phase of the operation thus goes off since it cannot be sustained, however, such glow is sustained within the cathode cavity. It is to be remembered that when a low current produces a glow between the annulus and the cathode and the anode, it is only the spectrum of the gas that is produced. There is little sputtering in this phase of the operation, since the current is too low for that condition to occur.

When the glow penetrates internal to the cathode and the density of sputtering increases, atoms of the metal are ionized, which emit the ultraviolet radiation. It is thus the spectrum of the metal that is radiated and not the spectrum of the gas which causes the eventual visual output on the visual segments 12–24. In complete opposition, it is the spectrum of the gas which generally provides for the visual output as provided in such prior art systems.

Referring now to FIGS. 1–4, there is shown the overall structure of segment display system 10 resulting in the allowable visual observation of one or more of visual segments 12–24. It is to be understood that the exploded partially cut-away view shown in FIG. 3 is directed to the concept of separation of the various elements making up segment display system 10, due to the complexity and close mating of the structure elements. As can be seen in FIG. 1, segment display system 10 is formed into a hermetically sealed housing structure 28 in order to maintain internally inserted gases, as has hereinbefore been described, at a predetermined pressure. The concept of forming such structures into hermetically sealed housings is well-known in the art. Segment display system 10 is thus generally formed into a monolithic type structure which optimizes the manufacture and use of segment system 10.

Segment display system 10 includes cathode mechanism 26 which is used for producing energy in the ultraviolet bandwidth of the electromagnetic spectrum from ionization of metallic atoms. Cathode 26 thus is adapted to produce energy in the ultraviolet bandwidth of the electromagnetic spectrum responsive to the ionization of metal atoms. Cathode mechanism 26 includes cathode plate member 30 shown in FIGS. 1, 2 and 3. Cathode plate member 30 includes opposing first and second surfaces 32 and 34, which are generally planar in contour and form a plane substantially normal to a vertical direction defined by directional arrow 36, shown in FIG. 2. Cathode plate member 30 may be formed of a generally electrically insulating material such as glass, ceramic, or some like material, not important to the inventive concept, as is herein described.

Although not important to the inventive concept as herein described, various dimensional characteristics of segment display system 10 will be described in following paragraphs to generally show scaling and relative dimensions between elements of display system 10 due to the fact that FIGS. 1–4 are greatly exaggerated, although in scale, in their conceptualization. The thickness or dimension in vertical direction 36 of cathode plate member 30 may be within the approximate range of 0.050–0.250 inches with a typical thickness dimension of 0.075 inches.

Each of cathode plate members 30 includes a plurality of cathode opening slots formed therethrough as represented by slot through opening 38, as shown in the cut-away section of FIG. 3. A plurality of slot through openings 38 are formed on each cathode plate member 30 in registration in the vertical direction with visual segments 12–24. In the description provided in the following paragraphs, one slot through opening 38 will be generally referred to for clarity purposes. In general, slot through openings 38 define a substantially rectangular contour in a plane normal to vertical direction 36. Such linearly directed slot through openings 38 thus may be formed into openings in registration with visual segments 12–24, shown in FIG. 1.

Each of cathode through openings 38 in combination with surrounding cathode plate member 30 define through opening sidewalls 40.

Although each of cathode slot through openings 38 are shown to be of constant cross-sectional area in direction 36, there may be provided an inclination in upward vertical direction 36. The inclination may provide for a slightly greater cross-sectional area at first surface 32 than at cathode plate member second surface 34, with an approximate vertical angle of 1.0°–5.0°. There may be some optimization of the directional displacement of the ultraviolet energy formed from the ionization of metallic atoms in direction 36 to impinge on fluorescent material to be described in following paragraphs when an inclination angle is provided. However, whether an inclination or a linearly directed constant cross-sectional area is used for through openings 38, will be dependent upon commercial costing.

Figure 4:
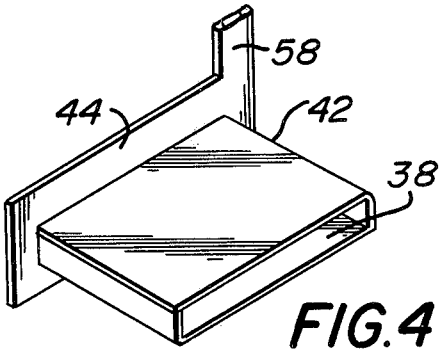
FIG. 4 is a perspective view of the overall geometric pattern of the metallic coatings forming the sidewalls of the through slots of the cathode mechanism; and, FIG. 5 is a cut-away sectional view of an embodiment of the segment display system, showing the fluorescent metallic coating formed on an internal surface of a display member.

Each of cathode slot through openings sidewalls 40 of slots 38 includes metallic coating 42 formed thereon. Metallic coating 42 may be formed of Aluminum, Nickel, Mercury, Copper, Lead, or some like metallic coating which would allow ionization of metallic atoms displaced from the surface during the operation of segment display system 10. Metallic coating 42, as shown in FIGS. 2–4, forms a metallic film on sidewalls 40 which may be in the approximate thickness range between 0.001–0.005 inches with a preferred thickness approximating 0.002 inches. Cathode mechanism 26 includes metallic coating annular section 44. As is clearly seen in FIG. 4, metallic coating annular section 44 is formed in an annular contour and is bonded to cathode plate member second surface 34. Thus, metallic coating annular section 44 provides for an extension coating portion bonded to second surface 34. Metallic coating extension portion 44 surrounds each of cathode plate member through slots 38.

Metallic coating annular sections or extensions 44 are generally formed of the same composition as metallic coating 42. Additionally, metallic sidewall coating 42 and extension coating portions 44 are preferably formed in continuous relation each to the other. Thus, extension coating portion 44 and sidewall metallic coatings 42 may be formed in one-piece formation, or bonded each to the other separately, such not being important to the inventive concept, as herein described, with the exception that metallic coating 42 and extension coating portion 44 be electrically conductive and coupled each to the other in an electrical coupling mode.

Metallic coating annular sections 44 thus include an internal diameter substantially equal to a cross-sectional area of cathode plate member through opening 38 adjacent cathode plate member second surface 34 of element 30. Metallic coating annular section 44 has a predetermined external dimension larger than plate through openings 38 with the external width dimensions and length dimensions to be discussed in following paragraphs in relation to other elements of segment display system 10.

Referring now to FIGS. 1–3, it is clearly seen that the plurality of slot through openings 38 formed through cathode plate member 30 are formed into a predetermined contour pattern on plate member 30 for numeric visual representation of all numbers between zero and nine. Associated with each slot through opening 38 and corresponding metallic coating 42 in association with visual segments 12–26, each of metallic coatings 42 of cathode plate member 30 of cathode mechanism 26 is electrically coupled to an external electrical source. Thus, there are provided electrical leads 46, 48, 50, 52, 54, 56, and 58 correspondingly associated with visual segments 12–24. The correspondence and coupling is shown in FIGS. 1–3. Each of electrical leads 46–58 pass external to housing structure 28 for coupling to an external electrical source. As is seen in FIG. 2, as provided for electrical lead 58, there may be included metallic coating conductive member 60 coupled on opposing ends thereof to metallic coating annular section 44 and to external electrical lead 58 for coupling to the external electrical source. Metallic coating conductive member 60 is represented in FIG. 2 as an extended member mounted to a wall of cathode plate member 30 and connecting external lead 58 to annular section 44. However, metallic coating conductive member 60 may be a metallic ink inserted within a recess formed within cathode plate member 30 on second surface 34 thereof. Such a recess may extend from the metallic coating of a predetermined slot through opening 38 to an end surface of cathode plate member 30 for coupling to a particular one of electrical leads 46–58. This type of coupling is clearly seen in the corresponding U.S. patent application Ser. No. 121,918, filed Mar. 5, 1980, entitled "DISPLAY SYSTEM", of which this is a continuation-in-part.

Referring to the dimensions of cavities or slot through openings 38 shown in FIGS. 2 and 3, such may typically have an extended linear length approximating 0.5 inches with a width of approximately 0.10 inches. However, such dimensions are clearly dependent upon the particular use of segment display system 10, and such may be extended or contracted dependent upon the size of the overall display being manufactured.

Segment display system 10 further includes anode mechanism 62 which is shown in FIGS. 2 and 3. Anode element 62 is secured to cathode plate member 30 and displaced from cathode plate member 30 second surface 34 for forming internal chamber 64 therebetween. In segment display system 10 of the subject concept, anode element 62 is a common anode for all of visual segments 12–14. Anode element 62 provides for an anode plate member which may be secured to cathode plate member 30 around a periphery thereof, as is shown in FIG. 2, wherein anode plate member or element 62 is coupled to cathode extension walls 66. Anode plate member 66 is formed of an electrically conductive material and further may be formed of Aluminum, or some like metal. Anode element 62 is coupled to anode electrical lead member 68 shown in FIG. 1. Anode electrical lead member is coupled on opposing ends to anode plate member 62 and an external electrical source (not shown).

Anode element 62 may be mounted or bonded to dielectric base member 70, as is shown in FIG. 2. Dielectric base member 70 may be secured to cathode plate member 30 in a manner for forming a hermetic seal between base member 70 and cathode plate member 30 through bonding techniques well-known in the art. Base member 62 may be bonded to dielectric base member 70 through sealing glass frit which may be screen printed. Glass frit 72 thus would interface on opposing sides thereof with dielectric base member 70 and anode plate element 62. In another concept, dielectric base member 70 may have a metallic coating applied to one surface thereof with the overall dielectric base member 70 being secured to cathode plate member 30 in the same manner. Thus, in one instance, an anode plate member 62 may be bonded to a lower dielectric base member 70. Alternatively, dielectric base member 70 may have a metallic coating such as Aluminum formed thereon and the entire combination being bonded to cathode plate member 30.

Lower dielectric base member 70 and anode element 62 whether being of a plate construction, or a coating formed on dielectric base member 70, may then be hermetically bonded to cathode plate member extension walls 66 through further addition of sealing glass frit 74 extending around the periphery of housing structure 28, as is seen in FIG. 2 and in the exploded section shown in FIG. 3.

Display panel mechanism 76 is secured to first surface 32 of cathode plate member 30. As is clearly seen in FIGS. 2 and 3, display panel mechanism 76 has formed thereon a plurality of fluorescent material coatings 78 which are in registration with cathode plate member through openings 38.

Display panel mechanism 76 includes display panel member 80, as will be described in following paragraphs, which is substantially transparent to a bandwidth of the electromagnetic spectrum substantially comprising the ultraviolet bandwidth. Thus, display panel member 80 of display panel mechanism 76 is clearly seen in FIG. 2 to have formed thereon fluorescent material coatings 78 for intercepting ultraviolet energy from ionization of metal atoms passed from the metallic coating 42 within slot through openings 38.

Display panel member 80 includes opposing first and second surfaces 82 and 84 as is shown in FIGS. 2 and 3. Display panel member 80 is bonded or fixedly secured to cathode plate member 30 through the use of sealing black glass frit film 86 or some like adhesive technique.

Glass frit film 86 provides for a vacuum seal between display panel member 80 and cathode plate member 30. Additionally, such further provides for substantial optical isolation of each slot through opening 38 when taken with respect to other openings 38 formed adjacent thereto. Film 86 may have a vertical dimension approximately within the range of 0.0005–0.001 inches.

Film 86 may be applied to cathode plate member first surface 32 by a printing screen or some like technique, not important to the inventive concept as is herein described. In this manner, display panel first surface 82 is bonded to cathode plate member first surface 32 in a secured and fixed manner.

Display panel member 80 as shown in the embodiments of FIGS. 2 and 3 may be formed of an ultraviolet transparent glass having a dimension thickness approximating 0.004 inches. Fluoroescent material 78 is secured to display panel member second surface 84 in registration above slot through openings 38. Thus, fluorescent material 78 includes a width substantially equal to the overall opening dimensions of cathode through slots 38 and have axis lines coincident with the axis lines of slots 38.

Fluorescent material or coating 78 may be one of a number of compositions such as various Phosphor compositions which radiate responsive to ultraviolet energy impinging thereon. A wide range of Phosphor compositions well-known in the art may be used for the fluorescent material coating 78. Coatings 78 may be protected against abrasion by protective coating layer element 88.

Layer element 88 may be a microsheet of glass, or may be a metallo organic solution to form a coating of low refractive index and high abrasion resistance. Thus, protective layer element 88, as is seen in FIGS. 2 and 3, interfaces with both fluorescent material coatings 78 and display panel membe second surface 84.

In the embodiment shown in FIG. 5, display panel means 76 is formed of display panel member 80' which is substantially opaque to a bandwidth of the electromagnetic spectrum substantially comprising the ultraviolet bandwidth. This substance may be a number of compositions well-known in the art. One such composition would be soda lime glass, which has been successfully used. In this embodiment, display panel member 80' includes first and second opposing surfaces 82' and 84'. Fluorescent material coatings 78' are fixedly secured to display panel first surface 82'. Once again, coating 78' is in registration with slot openings 38 displaced in a vertical direction therefrom. In this case, display panel first surface 82' may be coated with a protective film for Phosphor composition 78' by a protective film layer 90. Protective film layer 90 protects Phosphor composition 78' against possible ion bombardment. Protective film layer 90 may be a film of Tantalum Pentoxide produced by a metallo organic solution of a salt of Tantalum soluble in isopropyl alcohol.

In overall concept, as is clearly seen in FIG. 2, internal chamber 64 has a gaseous medium inserted therein to fill the volume provided by internal chamber 64 as well as slot openings 38. Upon actuation of an external electrical source, the gaseous medium is ionized by an electrical field applied to both anode element 62 as well as to cathode mechanism 26. Gaseous ions impinging on metallic coating 42 forming the through opening sidewalls 40, sputter the metal atoms to produce ultraviolet energy, as has hereinbefore been described. The gaseous medium inserted internal to segment display system 10 is formed of a substantially noble or inert gaseous composition, and may be formed from the group consisting of Neon, Argon, Krypton, Xenon, Helium, or combinations thereof.

Although this invention has been described in connection with specific forms and embodiments thereof, it will be appreciated that various modifications other than those discussed above may be resorted to without departing from the spirit or scope of the invention. For example, equivalent elements may be substituted for those specifically shown and described, certain features may be used independently of other features, and in certain cases, particular locations of elements may be reversed or interposed, all without departing from the spirit or the scope of the invention as described in the appended claims.

What is claimed is:

1. A segment display system comprising:

(a) cathode means for producing energy in the ultraviolet bandwidth of the electromagnetic spectrum from the ionization of metal atoms, said cathode means defining a cathode plate member having a plurality of discrete slots formed therethrough, said cathode plate member having opposing first and second surfaces, each of said through slots defining a sidewall having a metallic coating formed thereon;

(b) anode means fixedly secured to said cathode plate member and displaced from said cathode plate member second surface for forming an internal chamber therebetween; and, (c) display panel means secured to said cathode plate member first surface, said display panel means having formed thereon a plurality of fluorescent material coatings in registration with said cathode plate member through slots.

2. The segment display system as recited in claim 1 where said display panel means includes a display panel member being substantially transparent to a bandwidth of the electromagnetic spectrum substantially comprising the ultraviolet spectrum.

3. The segment display system as recited in claim 2 where said display panel member includes opposing first and second surfaces, said first surface of said display panel member being bonded to said first surface of said cathode plate member.

4. The segment display system as recited in claim 3 where said fluorescent material is fixedly secured to said second surface of said display panel member.

5. The segment display system as recited in claim 4 where said display panel member includes a protective coating layer applied over said display panel member second surface and said fluorescent material for abrasive protection of said fluorescent material.

6. The segment display system as recited in claim 5 where said display panel member first surface is adhesively bonded to said first surface of said cathode plate member.

7. The segment display system as recited in claim 4 where said fluorescent material is formed of a Phosphor composition.

8. The segment display system as recited in claim 1 where said display panel means includes a display panel member substantially opaque to a bandwidth of the electromagnetic spectrum substantially comprising the ultraviolet bandwidth.

9. The segment display system as recited in claim 8 where said display panel member includes opposing first and second surfaces, said first surface of said display panel member being bonded to said first surface of said cathode plate member.

10. The segment display system as recited in claim 9 where said fluorescent material is fixedly secured to said first surface of said display panel member.

11. The segment display system as recited in claim 10 where said display panel means includes an ionic protective coating layer applied over said display panel member first surface and said fluorescent material for protection of said fluorescent material responsive to ion impingement.

12. The segment display system as recited in claim 11 where said ionic protective coating layer is formed of a Tantalum Pentoxide composition.

13. The segment display system as recited in claim 10 where said display panel member first surface is adhesively bonded to said first surface of said cathode plate member.

14. The segment display system as recited in claim 10 where said display panel member is formed of a soda lime glass composition.

15. The segment display system as recited in claim 10 where said fluorescent material is formed of a Phosphor composition.

16. The segment display system as recited in claim 1 including a gaseous medium in proximity to said metallic coatings of said slot sidewalls, said gaseous medium being ionized by an electrical field applied to said anode and cathode means, said gaseous ions impinging on said metallic coatings for ionization of said metal atoms for producing said ultraviolet energy.

17. The segment display system as recited in claim 16 where said gaseous medium is formed of a substantially inert gas composition.

18. The segment display system as recited in claim 16 where said gaseous medium is formed from the group consisting of Argon, Neon, Krypton, Xenon, or Helium.

19. The segment display system as recited in claim 1 where said cathode plate member is formed of a substantially electrically insulating material.

20. The segment display system as recited in claim 19 where said cathode plate member is formed of a ceramic composition.

21. The segment display system as recited in claim 1 where each of said cathode plate member through slots are linearly extended, each of said through slots having a substantially rectangular cross-sectional contour.

22. The segment display system as recited in claim 1 where said cathode means metallic coating includes an extension coating portion bonded to said cathode plate member second surface, said metallic coating extension portion surrounding each of said cathode plate member through slots.

23. The segment display system as recited in claim 22 where said metallic sidewall coating and said extension coating portion are formed in continuous relation each to the other.

24. The segment display system as recited in claim 23 where said coating extension portion is annular in contour with respect to a cross-sectional contour of said cathode plate member through slots.

25. The segment display system as recited in claim 24 where said plurality of cathode plate member through slots are formed into a predetermined contour pattern on said cathode plate member for numeric visual representation of all numbers between zero and nine.

26. The segment display system as recited in claim 24 where each of said metallic coatings of said cathode plate member through slots is electrically coupled to an external electrical source.

27. The segment display system as recited in claim 26 including a metallic coating conductive member coupled on opposing ends thereof to one of said metallic coatings of one of said through slots and to said external electrical source.

28. The segment display system as recited in claim 27 where said metallic coating conductive member is a metallic ink inserted within a recess formed within said cathode plate member second surface, said recess extending from said metallic coating of a predetermined through slot to an end surface of said cathode plate member.

29. The segment display system as recited in claim 1 where said anode means includes an anode plate member secured to an outer periphery of said cathode plate member, said anode plate member being secured for forming a hermetic seal between said anode plate member and said cathode plate member.

30. The segment display system as recited in claim 29 where said anode plate member is formed of an electrically conductive metal.

31. The segment display system as recited in claim 30 where said anode plate member is formed of Aluminum.

32. The segment display system as recited in claim 29 where said anode means includes an anode electrical lead member coupled on opposing ends thereof to said anode plate member and an external electrical source.

33. The segment display system as recited in claim 1 where said anode means includes a dielectric base member having a metallic coating applied to one surface thereof, said dielectric base member being secured to said cathode plate member in a manner for forming a hermetic seal between said metal coated dielectric base member and said cathode plate member.

34. The segment display system as recited in claim 33 where said metallic coating is Aluminum.

35. The segment display system as recited in claim 33 where said anode means includes an anode electrical lead member coupled on opposing ends thereof to said metallic coating and an external electrical source.

* * * * *